US005452923A

United States Patent [19]

Smith

[11] Patent Number: 5,452,923

[45] Date of Patent: Sep. 26, 1995

[54] COILED TUBING CONNECTOR

[75] Inventor: Donald A. Smith, Innisfail, Canada

[73] Assignee: Canadian Fracmaster Ltd., Canada

[21] Appl. No.: 267,186

[22] Filed: Jun. 28, 1994

[51] Int. Cl.[6] ..... F21B 23/00; F16L 21/06

[52] U.S. Cl. ..... 285/145; 285/330; 166/378; 166/77.5; 166/382; 175/423

[58] Field of Search ..... 285/144, 145, 285/330, 133.2, 175; 175/423; 166/242, 328, 77.5, 382, 134

[56] References Cited

U.S. PATENT DOCUMENTS

| | | | |
|---|---|---|---|
| 1,637,055 | 7/1927 | Segelhorst | 285/145 |
| 2,017,451 | 7/1935 | Wickersham | 285/145 |
| 2,864,450 | 12/1958 | Burns | 285/145 |
| 3,216,503 | 11/1965 | Fisher, Jr. et al. | 285/145 |
| 4,646,827 | 3/1987 | Cubb | 285/145 |
| 4,711,326 | 12/1987 | Baugh et al. | 175/423 |
| 5,174,397 | 12/1992 | Currington | 175/423 |
| 5,215,151 | 6/1993 | Smith et al. | 175/45 |
| 5,306,050 | 4/1994 | Laflin et al. | 285/175 |
| 5,348,088 | 9/1994 | Laflin et al. | 166/134 |

FOREIGN PATENT DOCUMENTS

| | | | |
|---|---|---|---|
| 2198769 | 6/1988 | United Kingdom | 285/145 |

*Primary Examiner*—Eric K. Nicholson

*Attorney, Agent, or Firm*—Lerner, David, Littenberg, Krumholz & Mentlik

[57] ABSTRACT

There is described a method and apparatus for connecting the end of coiled tubing to a downhole tool string, comprising a first tubular housing having a first uphole and a second downhole end and a bore formed therethrough for a length of coiled tubing, a second tubular housing adapted for releasable connection to the downhole end of the first housing, the second housing having a first uphole and a second downhole end and a bore formed therethrough for receiving the length of coiled tubing at least partially into the second housing, slips adapted to at least partially surround the coiled tubing and having on an inner surface thereof raised projections for penetrating a contiguous surface of the coiled tubing for connection thereto, the slips additionally including connectors to interlock with cooperating connectors on the second housing for a non-rotatable torque transmitting connection therebetween, and a force transmitting member disposed between the slips and the first housing to maintain the slips in compressive contact with the coiled tubing.

13 Claims, 4 Drawing Sheets

COILED TUBING CONNECTOR

FIELD OF THE INVENTION

There is described a connector and more particularly a coiled tubing connector and a method by which coiled tubing is terminated and secured to the top of a downhole tool string used in the drilling and servicing of oil and gas wells.

BACKGROUND OF THE INVENTION

Increasingly, the drilling of oil and gas wells is no longer a matter of drilling vertically straight bore holes from the surface to a zone of hydrocarbon recovery using a traditional drilling platform surmounted by a derrick which supports a string of jointed drill pipe having a bit at the lower end thereof. Rather, technology and techniques have been developed to deviate the bore's trajectory at angles of up to and sometimes exceeding 90° from the vertical. Directional drilling offers numerous advantages including new approaches to oil and gas traps having non-conventional geometries, economic zone enhancement as can occur for example if the bore hole actually follows an oil or gas bearing strata, improved economics particularly in an overpressured environment (when formation pressure is sufficient to force hydrocarbons to the surface at potentially explosive rates) and reduced environmental degradation.

After deviating a bore hole from the vertical, it's obviously no longer completely practical to sustain continuous drilling operations by rotating the drill string in order to also rotate the bit. Preferably, only the bit, but not the string, is rotated by a downhole motor attached to the lower end of the drill string, the motor typically consisting of a rotor-stator to generate torque as drilling fluid passes therethrough, a bent housing to deviate the hole by the required amount and which also encloses a drive shaft therethrough to transmit the rotor/stator's torque to a bearing assembly, and a bit rotatably supported at the downhole end of the bearing assembly for cutting the bore hole.

Electronic means supported by a mule shoe in the bottom hole assembly and connected to the surface by a wire line passing through the interior of the drill string transmits information with respect to the degree and azimuth of the bore hole's trajectory so that it can be plotted and necessary adjustments made. Once the required direction of the hole's trajectory has been attained, the motor must be withdrawn from the well, the bent housing either removed or straightened (if it's of the adjustable sort) and the motor is then tripped back into the hole to resume drilling operations. Each time the motor requires service, or a change in the hole's trajectory is required, this process must be repeated. This results in substantial costs and down time largely due to the time required to make and break all of the joints as the drill string is tripped in and out of the hole.

SUMMARY OF THE INVENTION

To overcome this problem, discrete lengths of jointed drill pipe are being replaced where feasible with coiled tubing which is a single length of continuous, unjointed tubing spooled onto a reel for storage in sufficient quantity to exceed the maximum length of the bore hole being drilled. The injection and withdrawal of the tubing can be accomplished much more rapidly in comparison with conventional drill pipe due in large part to the elimination of joints. However, as with conventional pipe, drilling mud and wire lines for downhole instrumentation pass through the tubing's interior.

Coiled tubing has been extensively used for well servicing as well as for workovers within previously drilled holes.

More recently, tools and methods have been developed for the actual drilling of bore holes using coiled tubing and reference is made in this regard to U.S. Pat. No. 5,215,151 disclosing such a system. Generally speaking however, the tools so far developed for connecting and disconnecting the coiled tubing, which is not threaded, to downhole motors and tool strings suffer from numerous disadvantages, including poor resistance to rotation, inadequate strength, poor serviceability and general unreliability.

Accordingly, it is an object of the present invention to provide an improved coiled tubing connector by means of which the tubing is terminated and secured to the top of a tool string and which obviates and mitigates from the disadvantages of the prior art.

It is a further object of the present invention to provide a connector providing improved torsional resistance to rotation relative to the tool string.

According to the present invention then, there is provided a connector for connecting the end of coiled tubing to a downhole tool string, comprising a cylindrical top sub having a first uphole and a second downhole end and a bore formed therethrough for the coiled tubing, a cylindrical seal sub adapted for releasable connection to the top sub downhole thereof, having a first uphole and a second downhole end and a bore formed therethrough for receiving the coiled tubing at least partially therethrough, slip means adapted to at least partially surround the coiled tubing and having on an inner surface thereof means for penetrating a contiguous surface of the coiled tubing for connection thereto, the slip means additionally including means thereon to interlock with cooperating means on the seal sub for a torque transmitting connection therebetween, and a force transmitting member disposed between the slip means and the bore formed through the top sub to maintain the slip means in compressive contact with the coiled tubing when the top and seal subs are connected together.

According to the present invention then, there is also provided a method of connecting the terminal end of coiled tubing to a downhole tool string, comprising the steps of inserting said terminal end through a first tubular housing, inserting said tubular end into one end of a second tubular housing, at least partially surrounding said coiled tubing with slip members having means thereon to penetrate the surface of said coiled tubing, at least partially covering said slip members with a force transmitting member, applying a presetting force to said force transmitting member to cause penetration of said means on said slip members into the surface of said tubing to form a fixed, non-rotatable connection therebetween, removing said presetting force, and connecting said first and second housings together to maintain a compressive force on said force transmitting member.

BRIEF DESCRIPTION OF THE DRAWINGS

Preferred embodiments of the present invention will now be described in greater detail, and will be better understood when read in conjunction with the following drawings in which.

DETAILED DESCRIPTION

Figure 1:
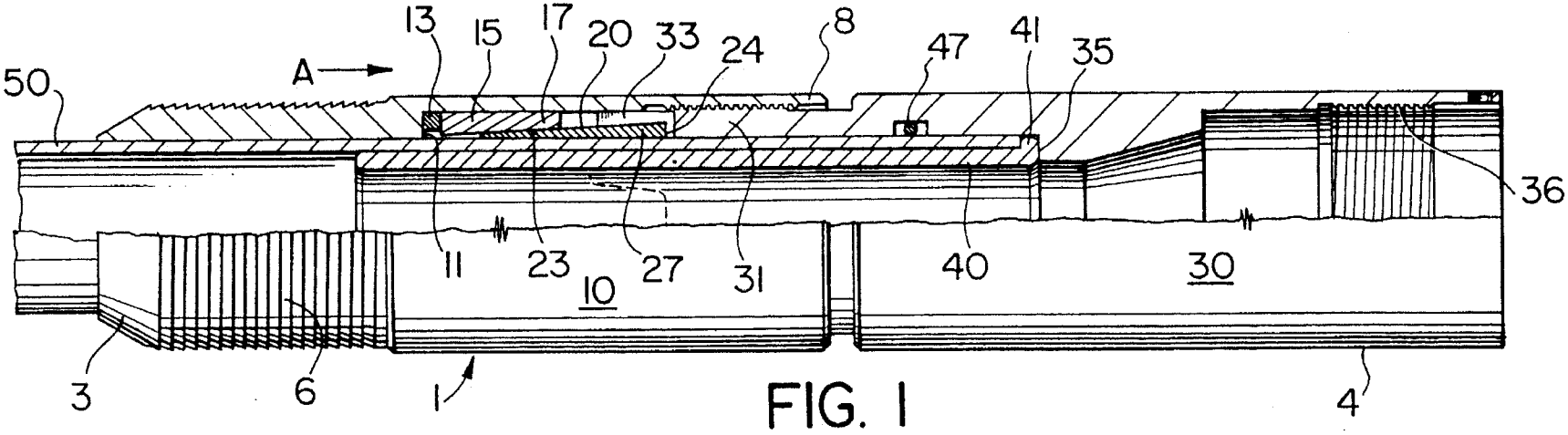
FIG. 1 is a side elevational, cross-sectional view of a coiled tubing connector.
Figure 4:
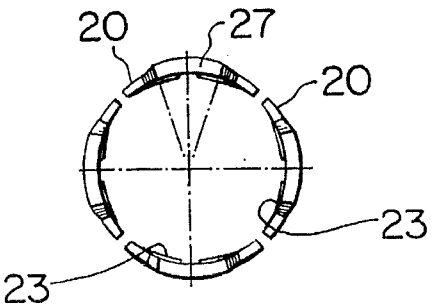
FIG. 4 is a top plan view of the slips of FIG. 1 indicating their curvature.
Figure 2:
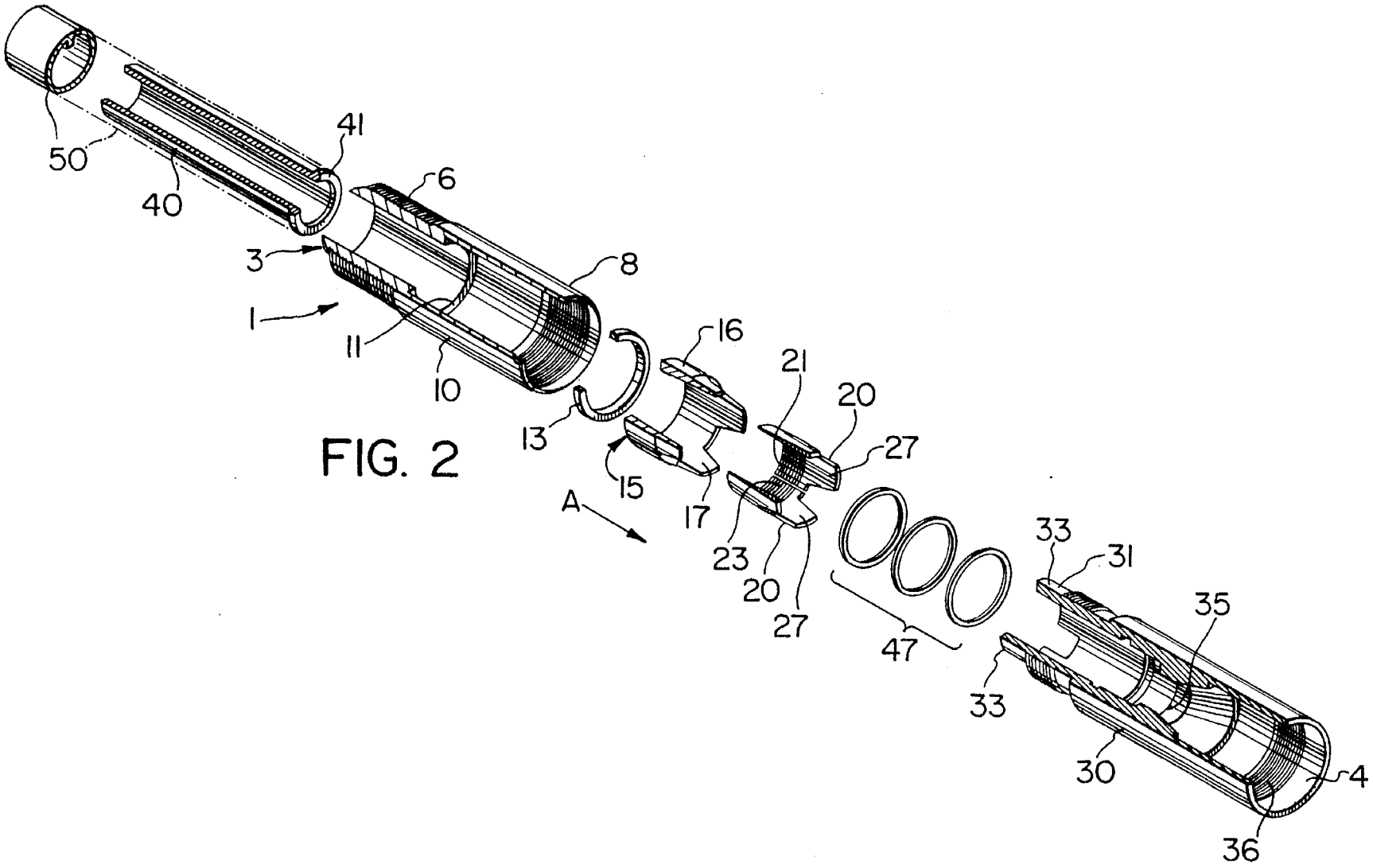
FIG. 2 is an exploded isometric, partially sectional, view of the connector of FIG. 1.

With reference now to FIGS. 1 and 2, the present connector 1 generally comprises from its uphole to its downhole ends 3 and 4 respectively a tubular top sub 10, a force transmitting wedge 15, a plurality of curved, wedge-shaped slips 20 and a tubular seal sub 30, the top and seal subs together defining a tubular housing.

Top sub 10 includes an externally buttress-threaded fishing neck 6 at its uphole end 3 and is internally threaded at its downhole end 8 for connection to the correspondingly externally threaded uphole end 31 of seal sub 30. The inner diameter of top sub 10 at its uphole end is dimensioned to slide over coiled tubing 50 and widens at shoulder 11 to accommodate washer 13, wedge 15, slips 20 and the uphole end of the seal sub.

As seen most clearly from FIG. 2, wedge 15 includes a cylindrical collar 16 having, in one embodiment constructed by the applicant, four spaced apart tapered fingers 17 extending axially therefrom in the downhole direction.

Each of fingers 17 overlies the uphole end 21 of respective ones of tapered slips 20. Slips 20 each of includes buttress threads 23 formed adjacent end 21 thereof on its inner surface facing tubing 50. The axial extent of the buttress threading coincides approximately to the length of the slips overlain by fingers 17 of wedge 15. By the applying a compressive force to wedge 15 acting in the direction of arrow A as will be described in greater detail below, buttress threads 23 on slips 20 will penetrate and bite into the outer surface of tubing 50 to form a connection therewith equal in strength to the tensile strength of the tubing itself.

It's critical that the connection between slips 20 and tubing 50 be capable of transmitting torque without relative rotation therebetween under maximum anticipated loading. In earlier systems, torque has been transmitted between the tubing and the connector by means of lugs or pins that pass through the connector's outer body into apertures or notches formed into the terminal end of the tubing. In the '151 patent mentioned above, this can be seen best from FIG. 11a wherein lugs 316 are received into notches or holes 322 in the tubing for transmission of torque.

The use of lugs or pins in this manner suffers from numerous disadvantages. The lugs can and will fall out in which event not only will the connection to the tubing be lost, but the lugs can jam in the hole and damage the tool string. The lugs can be sheared off or, if the lugs are stronger than the tubing, the apertures or notches in the tubing can distort or even "rip". There is the additional problem of actually forming the notches in the tubing under field conditions and doing so in proper registry with the holes for the lugs provided in the connector sleeve. Moreover, should the lugs fall out, be sheared off or simply loosen, drilling fluid passing through the tubing will escape resulting in a loss of circulation at the bit.

All of these problems are avoided by the present connector wherein slips 20 are themselves formed with dovetail fingers 27 that interlock with seal sub 30 to prevent rotation of tubing 50 relative to connector 1 as will now be described with reference to FIGS. 1 to 4.

Figure 3:
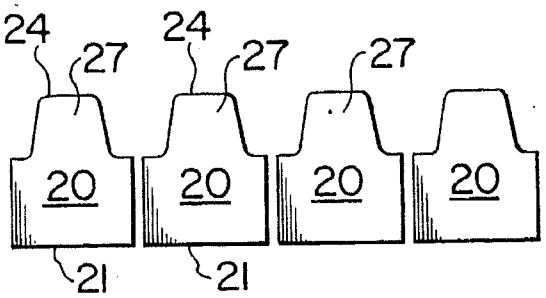
FIG. 3 is a flat elevational development of slips forming part of the connector of FIG. 1.

As seen most easily from the flat development of the slips shown in FIG. 3, each of slips 20 is generally T-shaped with the vertical stroke of the T defining a tapered finger 27. Fingers 27 are formed at the downhole ends 24 of slips 20 and are generally cross-sectionally thicker than ends 21 where buttress threads 23 are formed. Fingers 27 are dimensioned to closely mesh with co-operatively opposed teeth 33 provided at the uphole end 31 of seal sub 30. As will be appreciated, the meshing of fingers 27 and teeth 33 thusly prevents relative rotation between tubing 50 and connector 1 without perforation of the tubing and without the need for lugs or pins.

Figure 5:
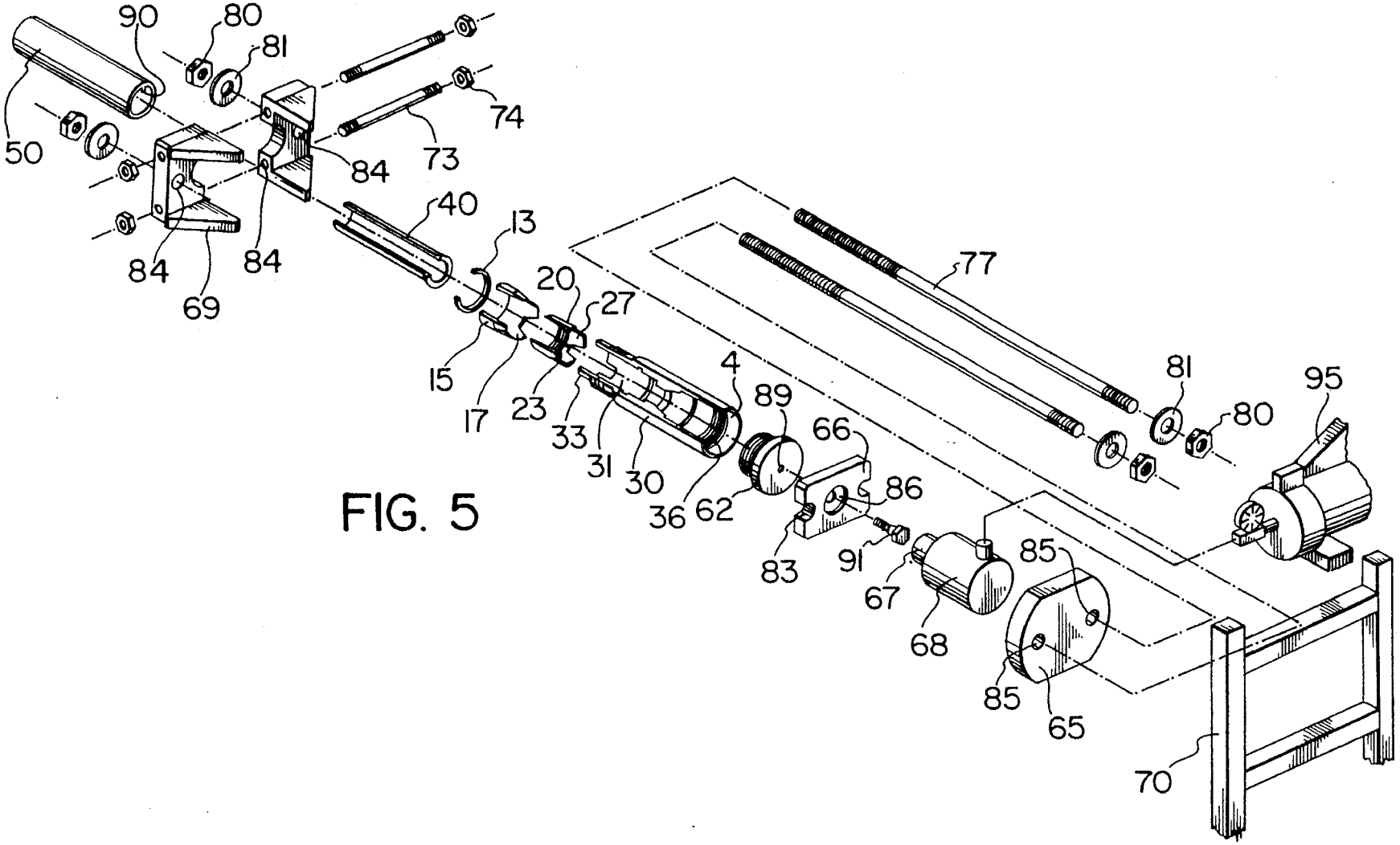
FIG. 5 is an exploded isometric, partially sectional, view of a presetting load press for use in connecting the connector of FIG. 1 with coiled tubing.
Figure 6:
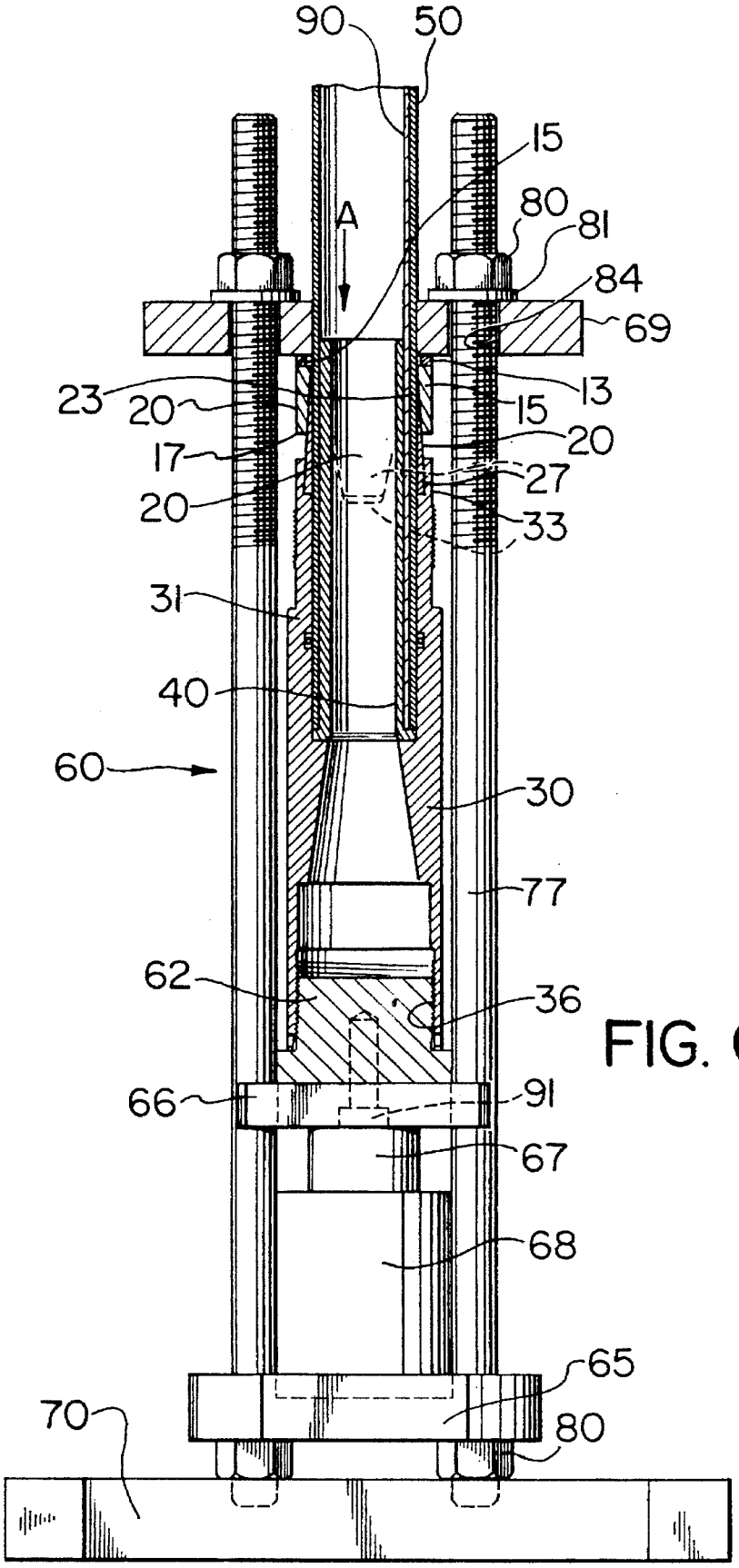
FIG. 6 is a side elevational, partially cross-sectional, view of the load press of FIG. 5.

With reference to FIGS. 5 and 6, connector 1 is connected to tubing 50 by first sliding the top sub 10 over the terminal end of tubing 50 and holding this sub up and away from tubing is the lower end in any suitable fashion. Washer 13 and wedge 15 are then placed over the tubing with fingers 17 of the wedge extending in the downhole direction. The terminal end of the tubing, including an internal tubular support 40 fitted concentrically therein to prevent crushing of the tubing during application of the compressive force on wedge 15, and which has been externally grooved to engage the factory seam 90 in the coiled tubing, is then inserted into the upstream end 31 of seal sub 30. Seal sub 30, including the end of tubing 50 inserted therein, is supported on a push plate 66 of a presetting load press 60 that will be described in greater detail below. Slips 20 are then individually placed by hand around the tubing with fingers 27 loosely positioned between teeth 33 on seal sub 38. Washer 13 and wedge 15 are then lowered down the tubing and over the uphole ends of the slips to overlie the same as best seen from FIG. 6. A top plate 69 of press 60 is then assembled over washer 13 and wedge 15. Press 60 is then used to apply a compressive force to the washer and wedge which causes buttress threads 23 on the slips to bite into the tubing's outer surface. Wedge 15 is oriented so that its fingers 17 also mesh between seal sub teeth 33 as the loading progresses. In one embodiment constructed by the applicant, press 60 applies a compressive force of 60,000 pounds to wedge 15. Following compression, top plate 69 is removed and top sub 10 is lowered down the tubing for a torqued threaded connection to seal sub 30 so that wedge 15 maintains slips 20 in compressive contact with the coiled tubing (as seen best in FIG. 1) and which completes the assembly of the connector to the tubing.

Although the torqued connection between the top and seal subs can itself cause loading of slips 20 against tubing 50, preloading of the slips as described above ensures a far stronger rotation-resistant connection of the slips to the tubing in the event of maximum anticipated loading on the connector.

The downhole end 4 of seal sub 30 is internally threaded at 36 for connection to the remainder of the downhole tool string.

With reference once again to FIGS. 5 and 6, there will now follow a more detailed description of load press 60.

From the ground up, press 60 includes a ground-engaging frame 70, a base plate 65 for supporting a 30-ton hydraulic ram 68 thereon, the ram having a 2 7/16 inch stroke, a push plate 66 atop the ram's piston rod 67 and an externally threaded push plug 62 adapted for connection to threads 36 of seal sub 30. Top plate 69 is formed in two symmetrical halves for assembly about tubing 50 by means of stud bolts 73 and nuts 74. The compressive force generated by ram 68 is transferred to top plate 69 by means of elongated stud bolts 77 which pass through apertures 84 and 85 in top and base plates 69 and 65 respectively and that are removably secured into place by means of nuts 80 and washers 81. Push plate 66 includes notches 83 formed into its opposite ends, the notches being sized to partially conformably surround bolts 77 seated therein. The push plate additionally includes an aperture 86 formed therethrough in registry with a threaded aperture 89 in the bottom of push plug 62 so that the two can be connected together such as by means of a threaded fastener 91. Power to hydraulic ram 68 is provided by a prime mover such as a hydraulic hand pump 95. As will be appreciated, the presetting load press is maintained in a substantially assembled condition apart from the top plate which is assembled to the unit for compressive loading of wedge 15 against slips 20.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. A connector for connecting the end of coiled tubing to a downhole tool string, comprising:

a first tubular housing having a first uphole and a second downhole end and a bore formed therethrough for a length of coiled tubing;

a second tubular housing adapted for releasable connection to said downhole end of said first housing, said second housing having a first uphole and a second downhole end and a bore formed therethrough for receiving said length of coiled tubing at least partially into said second housing;

slip means adapted to at least partially surround said coiled tubing and having on an inner surface thereof means for penetrating a contiguous surface of said coiled tubing for connection thereto, said slip means additionally including means thereon to interlock with cooperating means on said second housing for a non-rotatable torque transmitting connection therebetween; and force transmitting means disposed between said slip means and said first housing to maintain said slip means in compressive contact with said coiled tubing.

2. The connector of claim 1 wherein said slip means comprise a plurality of curved slips, each of said slips being curved about the longitudinal axis thereof for contact between an inner surface of each of said slips and a contiguous opposed surface of said coiled tubing.

3. The connector of claim 2 wherein said means to interlock and said cooperating means on said second housing comprise opposed finger members adapted to cooperatively mesh to prevent rotation of said second housing relative to said slips.

4. The connector of claim 3 wherein said force transmitting means comprise a cylindrical wedge disposed concentrically between said slip means and said first housing.

5. The connector of claim 4 wherein the connection between said first and second housings causes said wedge to exert a compressive force on said slip means to maintain the latter in compressive contact with said coiled tubing.

6. The connector of claim 5 wherein said wedge includes finger members thereon axially aligned to at least partially overlie respective ones of said slips.

7. The connector of claim 6 wherein said finger members on said wedge are adapted to mesh with opposed ones of said finger members on said second housing.

8. The connector of claim 7 wherein at least a portion of said inner surface of each of said slips includes thereon raised means for penetrating said contiguous surface of said coiled tubing.

9. The connector of claim 8 wherein said raised means comprise buttress threads.

10. The connector of claim 9 wherein said slips are wedge shaped in longitudinal cross-section, thickening in the direction of said finger members thereon.

11. The connector of claim 10 further including a tubular support member provided in an end of said coiled tubing received into said first and second housings to reinforce said coil tubing against compressive force applied thereto through said slip means.

12. A method of connecting the terminal end of coiled tubing to a downhole tool string, comprising the steps of:

inserting said terminal end through a first tubular housing;

inserting said tubular end into one end of a second tubular housing;

at least partially surrounding said coiled tubing with slip members having means thereon to penetrate the surface of said coiled tubing;

at least partially covering said slip members with a force transmitting member;

applying a presetting force to said force transmitting member to cause penetration of said means on said slip members into the surface of said tubing to form a fixed, non-rotatable connection therebetween;

removing said presetting force; and connecting said first and second housings together to maintain a compressive force on said force transmitting member.

13. The method of claim 12 wherein said slip means and said second housing have means thereon preventing rotation of said housing relative to said slip means.

* * * * *

UNITED STATES PATENT AND TRADEMARK OFFICE

CERTIFICATE OF CORRECTION

PATENT NO. : 5,452,923

DATED : September 26, 1995

INVENTOR(S) : Donald A. Smith

It is certified that error appears in the above-indentified patent and that said Letters Patent is hereby corrected as shown below:

Column 3, line 33, delete "Slips 20 each of" and insert therefor --Each of slips 20--.
line 37, delete "the".
Column 4, line 21, delete "tubing is the" and insert therefor --the tubing's--.
line 34, delete "38" and insert therefor --30--.
Column 5, line 52, delete "curved".

Signed and Sealed this

Twenty-eighth Day of November 1995

*Attest:*

Bruce Lehman

BRUCE LEHMAN

*Attesting Officer*

*Commissioner of Patents and Trademarks*